US005195815A

United States Patent [19]

Watanabe et al.

[11] Patent Number: 5,195,815

[45] Date of Patent: Mar. 23, 1993

[54] ANTIGLARE BULB SHADE FOR A VEHICLE HEADLAMP

[75] Inventors: Takao Watanabe; Akio Mochizuki, both of Shimizu, Japan

[73] Assignee: Koito Manufacturing Co., Ltd., Tokyo, Japan

[21] Appl. No.: 733,773

[22] Filed: Jul. 22, 1991

[30] Foreign Application Priority Data

Jul. 23, 1990 [JP] Japan ..... 2-194589

[51] Int. Cl.[5] ..... F21M 3/14

[52] U.S. Cl. ..... 362/61; 362/351

[58] Field of Search ..... 362/61, 80, 255, 257, 362/351

[56] References Cited

U.S. PATENT DOCUMENTS

| | | | |
|---|---|---|---|
| 4,268,895 | 5/1981 | Yabata . | |
| 4,321,658 | 3/1982 | Deverrewaere . | |
| 4,882,660 | 11/1989 | Liverance et al. . | |
| 4,893,218 | 1/1990 | Dilk et al. | 362/61 |
| 4,922,398 | 5/1990 | Muto . | |
| 4,926,301 | 5/1990 | Liverance et al. | 362/61 |
| 4,945,453 | 7/1990 | Serizawa et al. . | |
| 5,010,458 | 4/1991 | Fraizer | 362/351 |
| 5,067,054 | 11/1991 | Oshio et al. | 362/61 |

*Primary Examiner*—Richard R. Cole

*Attorney, Agent, or Firm*—Sughrue, Mion, Zinn, Macpeak & Seas

[57] ABSTRACT

An antiglare vehicle headlamp has an electric lighting bulb disposed in a lighting chamber defined by a lamp body and a cover lens secured thereto. A generally concave reflector is aimably mounted in the lighting chamber for reflecting the light rays from the bulb along the optical axis of the headlamp. The bulb has a substantially tubular envelope portion of vitreous material containing a filament, and a flat base portion formed in one piece with the envelope portion. As the base portion is conventionally formed by pinch sealing, a generally tapering part of indefinite shape and wall thickness is created between the envelope portion and the base portion. The indefinitely tapering part will refract in various directions the light rays emitted by the bulb filament. Should they be subsequently reflected by the reflector, such random light rays would not travel parallel to the optical axis, and some of them, issuing upwardly from the headlamp, would cause glare. A light shade is disposed between the bulb and the reflector for cutting off such glare causing ones of the light rays that have traversed the indefinitely tapering part of the bulb. Another embodiment is disclosed in which the lamp body has its inside surface rendered reflective, thereby dispensing with a separate reflector. The light shade is formed directly on the reflective surface of the lamp body.

16 Claims, 8 Drawing Sheets 66
64
70
20
58
50
92
94
90
98
22
52
56
62
70
54
48
60
68
94
96
100
104
104
114
106
112
114
24
108
108
112
110
110

ANTIGLARE BULB SHADE FOR A VEHICLE HEADLAMP

BACKGROUND OF THE INVENTION

Our invention relates generally to electric lamps and particularly to those suitable for use on motor vehicles as headlamps. Still more particularly, our invention has to do with a vehicle headlamp of the kind having an incandescent lamp bulb, featuring provisions for protecting the drivers of oncoming vehicles as well as pedestrians from glare.

Incandescent lamp bulbs have been used extensively as light sources of vehicle headlamps. Normally, incandescent bulbs for vehicular headlamp applications have an envelope of vitreous material containing a filament. The envelope is formed in one piece with a base portion through which extend a pair of lead wires connected to the filament within the envelope portion. As is well known, the base portion is formed by pinch sealing one end of the tubular envelope; indeed, the base portion is sometimes referred to as a pinch seal. Pinch sealing is a widely practiced, efficient way of hermetically closing one end of the tubular envelope and, at the same time, providing the base portion in one piece with the envelope portion.

However, this practice has presented an inconvenience that has heretofore been left not completely resolved, particularly in use of incandescent lamp bulbs of this type as light sources of vehicular headlamps. The pinch sealing of one end of the tubular envelope unavoidably creates a generally tapering part of indefinite external shape and wall thickness between the envelope portion and the base portion.

Suppose that this bulb is mounted in position in a lighting chamber defined by and between a generally concave or paraboloidal reflector and a cover lens secured thereto. The rays of light that have been emitted by the bulb filament and which have passed through the tubular envelope portion will be reflected by the reflector into rays parallel to the optical axis of the headlamp unit. Then the parallel light rays will be directed by the cover lens to provide a desired beam pattern.

The light rays that have traversed the indefinitely tapering part of the bulb, on the other hand, will be thereby variously refracted. Subsequently reflected by the reflector, such random light rays will propagate in various directions at angles to the optical axis. The cover lens is incapable of converging the random rays into the desired beam pattern. Of the random rays issuing from the cover lens, those angled upwardly provide a cause of glare, dazzling the drivers of oncoming vehicles.

Conventionally, with a view to the reduction of such random rays deviating from the beam pattern, the bulb has been mounted to the lamp body or to the reflector in such a manner as to minimize the amount of rays that hit the reflector after traveling through the indefinitely tapering part of the bulb. We object to this conventional practice, first because it is a makeshift measure incapable of thoroughly eliminating the glare causing rays. Second, it has imposed limitations upon the internal design of the headlamp, particularly with regard to how to mount the bulb to the lamp body or to the reflector.

SUMMARY OF THE INVENTION

We have hereby invented, in a vehicular headlamp of the type defined, how to effectively cut off the light rays that have traversed the indefinitely tapering part of the bulb, before they impinge on the reflector, thereby practically thoroughly eliminating the random rays issuing from the headlamp to cause glare.

Briefly, our invention may be summarized as a glare free vehicle headlamp comprising a lamp body and a cover lens secured thereto to define a lighting chamber therebetween. Mounted in the lighting chamber, an electric lighting bulb has an envelope portion of vitreous material containing a filament, and a base portion formed in one piece with the envelope portion. The base portion is formed by pinch sealing, so that the bulb has indefinitely tapering part between the envelope portion and the base portion. Also disposed in the lighting chamber is a reflector means for reflecting the light rays that have been emitted by the bulb filament and which have passed through the envelope portion, and hence for producing light rays that are parallel to the optical axis. Our invention particularly features an antiglare shade disposed between the bulb and the reflector means for cutting off at least some of light rays that have been emitted by the filament of the bulb and which have passed through the indefinitely tapering part of the bulb, in order to prevent the reflector means from producing light rays that are angled with respect to the optical axis and that will issue from the headlamp at such an angle with respect to the plane of the horizon as to cause glare.

Purely for the purpose of reducing the amount of glare causing rays of light to a minimum, it is unnecessary to shield the reflector means from all the random rays that have traversed the indefinitely tapering part of the bulb. All that is needed for the accomplishment of this purpose is to cut off only those of the random rays which, if allowed to hit the reflector means, would issue angled upwardly from the headlamp.

Accordingly, in the preferred embodiments of our invention disclosed herein, the antiglare shade takes the form of a simple curved strip of sheet material. In one embodiment the antiglare shade is formed as part of a shade structure additionally comprising a tubular portion loosely encircling part of the envelope portion of the bulb. This tubular shade together with an associated support structure has been conventionally used for cutting off the unnecessary light rays that have passed through that part of the bulb envelope which is closer to the cover lens. The fabrication of the antiglare shade of our invention in one piece with the conventional shade structure offers the advantage that no dedicated mounting means is required for the antiglare shade.

In another embodiment the antiglare shade according to our invention is separate from the shade structure and is formed in one piece with the lamp body or reflector. Therefore, in this case, too, no mounting means is required for the antiglare shade structure. It will be appreciated that regardless of whether the antiglare shade is integral with or separate from the conventional shade, it requires no major alteration of the existing parts of the headlamp.

Our invention is applicable to headlamps of both aimable and non-aimable types. We will disclose embodiments representing both types.

The above and other features and advantages of our invention and the manner of realizing them will become more apparent, and the invention itself will best be understood, from a study of the following description and appended claims, with reference had to the attached drawings showing the preferred embodiments of our invention.

DESCRIPTION OF THE PREFERRED EMBODIMENTS

General

Figure 1:
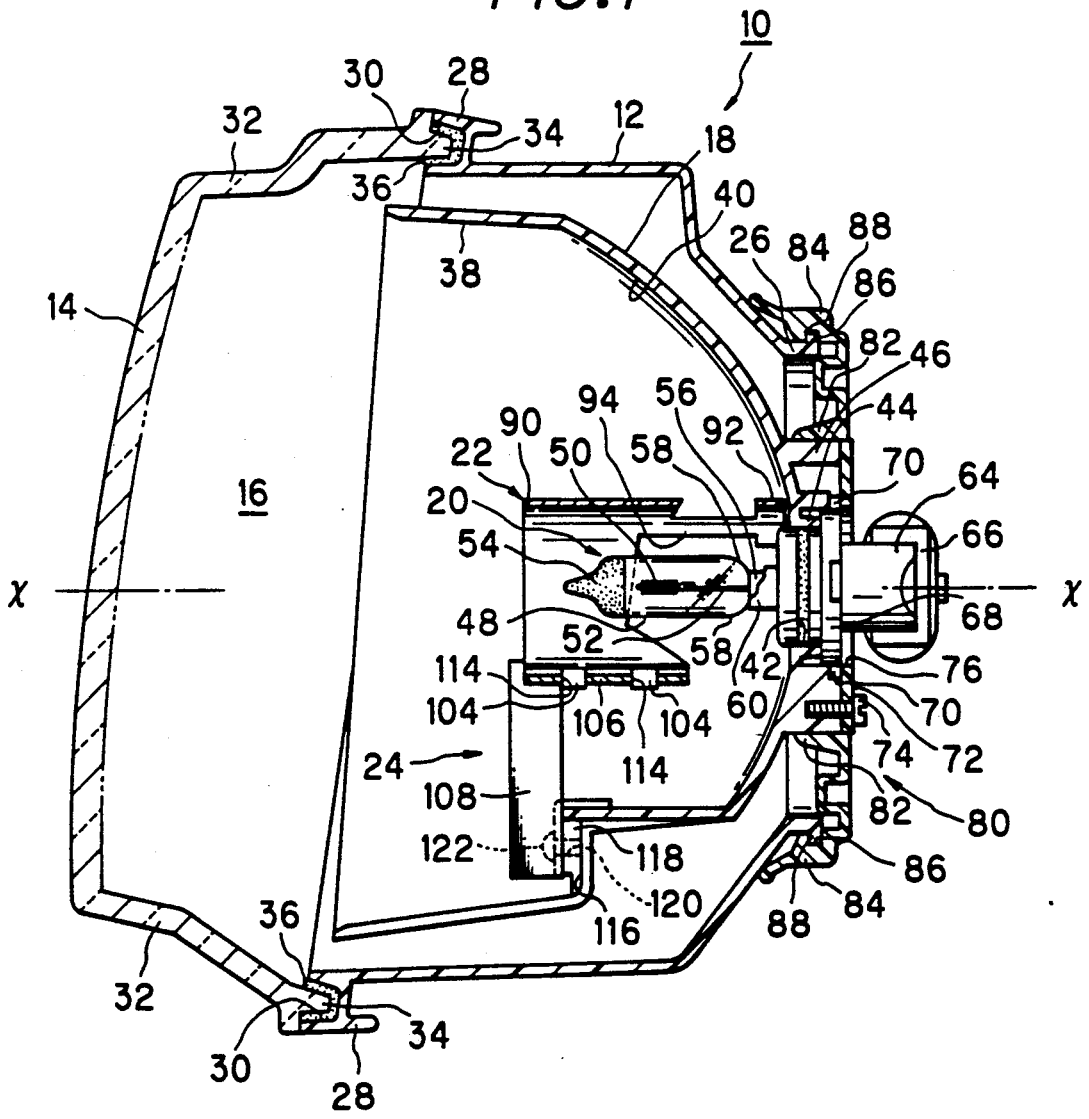
FIG. 1 is a vertical section through an aimable vehicle headlamp embodying the principles of our invention.
Figure 2:
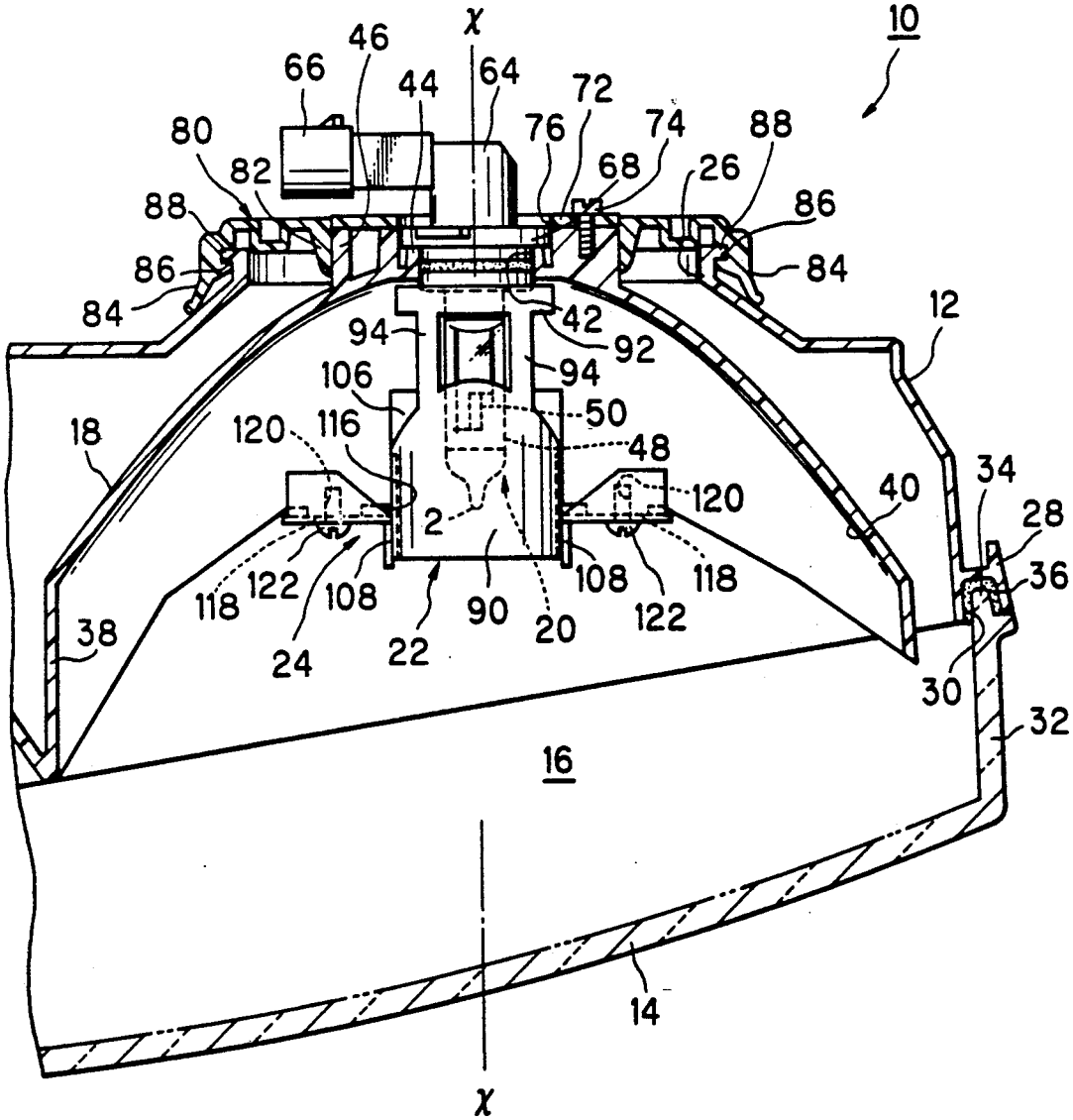
FIG. 2 is a partial horizontal section through the headlamp.

We will first describe our invention as embodied in the dual bulb, aimable headlamp illustrated in FIGS. 1-6. Reference may be had primarily to FIGS. 1 and 2 for a consideration of the general organization of this representative headlamp. Generally designated 10, the headlamp has a lamp body 12 to be mounted fast to the motor vehicle which is not shown. A cover lens 14 is secured to the lamp body 12 to define a lighting chamber 16 therebetween.

Disposed in the lighting chamber 16 are a pair of generally concave reflectors 18, one shown, which are both oriented toward the cover lens 14. The reflectors 18 are mounted to the lamp body 12 via aiming means, not shown, which are well known in the art. The unshown aiming means permit the reflectors 18 to be tilted both horizontally and vertically with respect to the lamp body 12.

A pair of electric lighting bulbs 20, also one shown, are disposed centrally within the respective concave reflectors 18. The bulbs 20 are rigidly coupled to the respective reflectors 18, besides being elastically coupled to the lamp body 12 via the reflectors. The rays of light emitted by the bulbs 20 are reflected by the reflectors 18 in order to provide parallel rays traveling along the optical axes X—X of the headlamp 10 toward the cover lens 14.

At 22 are seen a pair of antiglare shade structures, also one shown, constituting a feature of our invention. The antiglare shade structures 22 function to shield the reflectors 18 from those of the light rays emitted by the bulbs 20 which, if allowed to be reflected by the reflectors 18, would travel toward the cover lens 14 at angles to the optical axes X—X. Each antiglare shade structure 22 is mounted fast to one reflector 18 via a support structure 24.

Thus, since the bulbs 20, antiglare shade structures 22 and support structures 24 are all rigidly coupled to the reflectors 18, all these components are jointly tiltable with respect to the lamp body 12. The unshown aiming means therefore permit the aiming of the light beam produced by the headlamp 10.

We will discuss in more detail hereafter the above listed lamp body 12, pair of reflectors 18, pair of lighting bulbs 20, pair of antiglare shade structures 22, and pair of support structures 24, in that order and under separate headings. Since the pair of reflectors 18, pair of lighting bulbs 20, pair of antiglare shade structures 22, and pair of shade support structures 24 are all of identical make, we will describe only one of each such pair of components, it being understood that the same description applies to the other component.

Lamp Body

Figure 3:
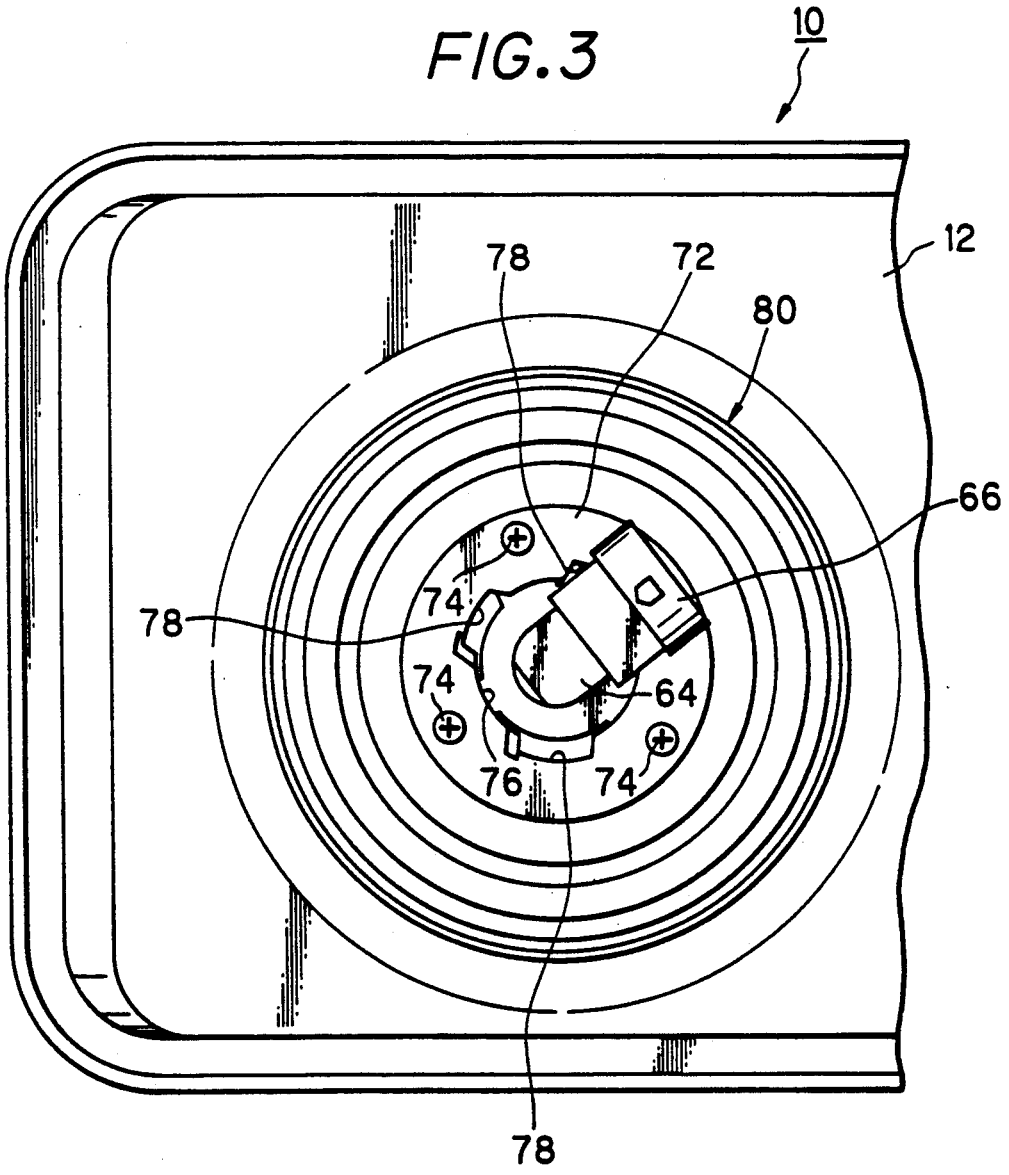
FIG. 3 is a partial rear elevation of the headlamp.

With reference to FIGS. 1-3 we have shown the lamp body 12 as a unitary molding of a plastic. The lamp body 12 is generally boxlike in shape, elongated horizontally for accommodating the pair of reflectors 18 and the other noted pairs of components mounted to these reflectors.

Hereinafter in this specification, we will use the directional terms such as "front" and "rear", and "forward" and "rearward", as well as derivatives thereof, to refer to the right and to the left, respectively, of the headlamp 10 as viewed in FIG. 1. Thus, for example, the lamp body 12 has an open front end to which the cover lens 14 is attached in a manner yet to be described, and has a pair of annular rims 26, one seen, projecting rearwardly from its closed rear end and defining openings of circular shape therein.

The lamp body 12 is formed in one piece with a flange 28 of T shaped cross section extending all along its front edge. The flange 28 defines a forwardly open groove 30 of annular shape. The cover lens 14 has an annular rim 32 turned rearwardly from its periphery. The edge 34 of the cover lens rim 32 is received with clearance in the lamp housing groove 30 and firmly retained therein by retainer springs, not shown. Additionally, a suitable sealant such as an adhesive 36 is filled in the space left in the lamp housing groove 30 by the cover lens edge 34.

The cover lens 14 is a generally planar piece of vitreous or other transparent material, conventionally formed to include flutes, prisms or the like, not shown, to serve as a lens. As the reflector 18 produces parallel rays of light as aforesaid, the cover lens 14 functions to transmit and direct them into a desired beam pattern in accordance with standard practice in the art.

Reflector

With reference to FIGS. 1 and 2 the reflector 18 is shown as a generally cup shaped molding of a plastic complete with a forward extension 38 of tubular shape. Shaped like a paraboloid of revolution, the inside surface 40 of the reflector 18 is rendered reflective, as by vapor deposition of aluminum, for reflecting the light rays emitted by the lighting bulb 20 and impinging thereon via the antiglare shade structure 22.

A mounting hole 42 is cut centrally in the reflector 18 for mounting the lighting bulb 20. The reflector 18 has two annular rims 44 and 46 concentrically surrounding the mounting hole 42 and extending rearwardly therefrom. The outer reflector rim 46 extends rearwardly to a greater extent than does the inner reflector rim 44.

Lighting Bulb

Figure 4:
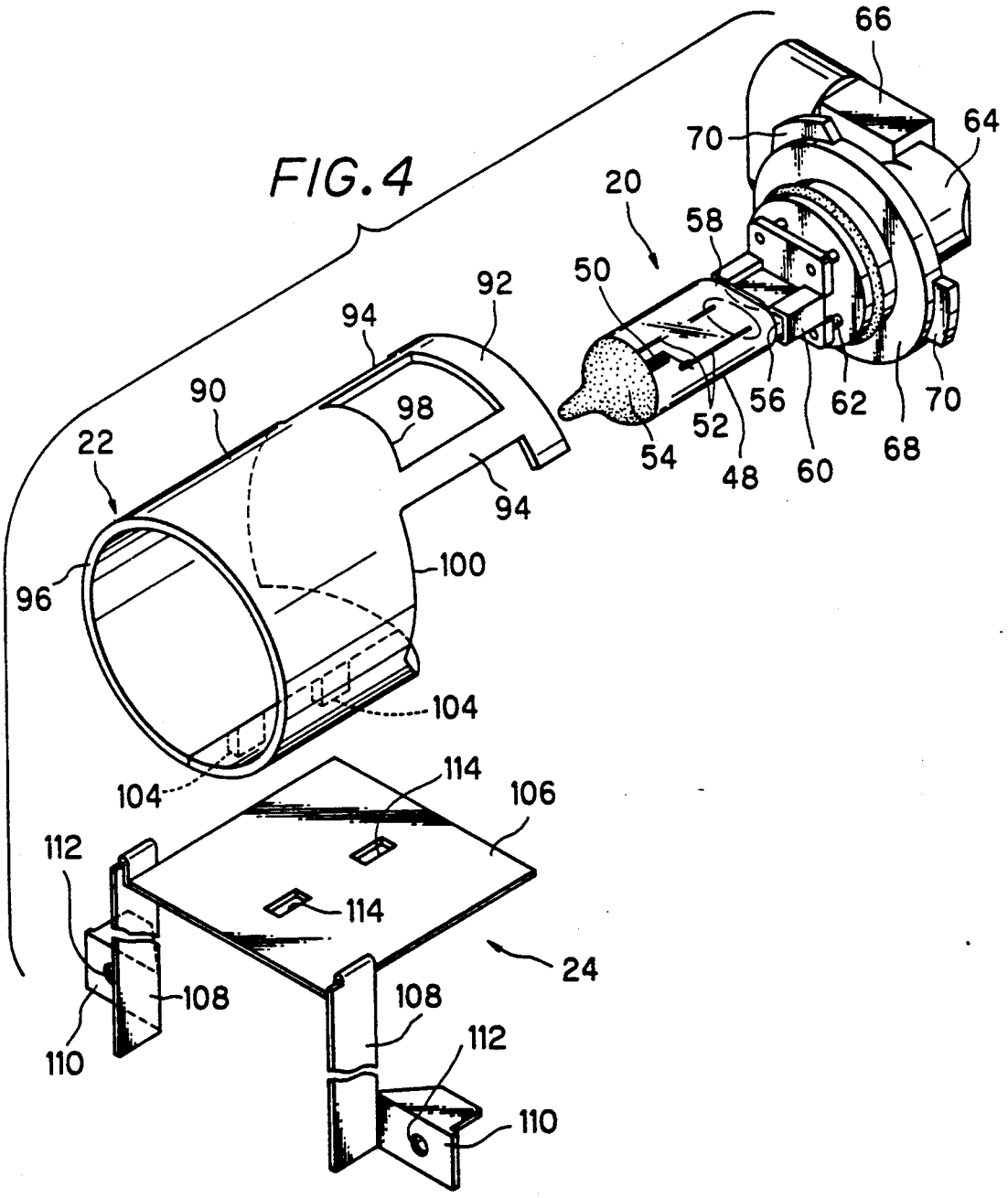
FIG. 4 is an enlarged, exploded perspective view showing the electric lighting bulb, antiglare shade structure, and shade support structure of the headlamp.

The lighting bulb 20 is illustrated in side elevation in FIG. 1, in phantom outline in FIG. 2, and in perspective in FIG. 4. We have shown the bulb 20 as a single filament incandescent lamp of well known construction, widely used with this type of vehicle headlamp. The bulb 20 has a generally tubular envelope portion 48 of vitreous material containing a coiled filament 50 supported between a pair of lead wires 52. The axis of the coiled filament 50 is aligned with the optical axis X—X.

The tubular envelope portion 48 is of one piece construction with a tip end portion 54 and a base portion 56. The tip end portion 54 has an opaque coating, preferably black in color, formed thereon.

As has been set forth in reference to the prior art, the base portion 56 is conventionally formed by pinch sealing. Generally tapering part 58 of indefinite external shape and wall thickness is therefore created between envelope portion 48 and base portion 56. It is this definitely tapering part of the bulb 20 that has so far given rise to the problem of glare mentioned previously. We will make clear, as the description proceeds, how we have overcome this inconvenience.

At 60 in FIGS. 1 and 4 is seen a metal made bulb holder rigidly encircling the base portion 56 of the bulb 20. The bulb holder 60 is welded to a set of pins 62, FIG. 4, embedded in and projecting forwardly from a socket portion 64 which is molded from a plastic in one piece with a connector portion 66. The connector portion 66 extends right angularly from the rear end of the socket portion 64. The socket portion 64 has an integral flange 68 complete with a plurality of, three in this embodiment, lugs 70 extending radially therefrom. The bulb 20 with the socket portion 64 and connector portion 66 is rigidly mounted to the reflector 18 in the following manner.

As shown in FIGS. 1-3, a bulb retainer ring 72 is screwed at 74 to the outer reflector rim 46. The bulb retainer ring 72 defines a hole 76 which is somewhat greater in diameter than the mounting hole 42 in the reflector 18 and than the flange 68 on the socket portion 64. Further the bulb retainer ring 72 is internally recessed at 78, FIG. 3, for permitting the passage of the lugs 70 on the socket flange 68 in mounting the bulb 20 to the reflector 18.

For mounting the bulb 20, the bulb retainer ring 72 may first be screwed to the outer reflector rim 46. Then the bulb 20, together with the socket portion 64 and connector portion 66, may be inserted forwardly in and through the hole 76 in the bulb retainer ring 72 and through the mounting hole 42 in the reflector 18 until the flange 68 on the socket portion 64 comes into abutment against the inner reflector rim 44. In so inserting the bulb 20, its angular position about its own axis may be adjusted with respect to the bulb retainer ring 72 so that the lugs 70 on the socket flange 68 may pass through the recesses 78 in the bulb retainer ring. Then the bulb 20 may be turned in either direction about its own axis relative to the reflector 18, to such an angular position that the socket flange lugs 68 are caught firmly between the rear edge of the inner reflector rim 44 and the front face of the bulb retainer ring 72. Further, with the bulb 20 thus mounted to the reflector 18, the socket flange 68 will be caught firmly by and within the inner reflector rim 44.

As has been stated, in this particular embodiment, the reflector 18 with the bulb 22 mounted thereto as above must be tiltable both horizontally and vertically with respect to the lamp body 12. It will be noted from FIGS. 1 and 2 that a large clearance is provided between lamp body rim 26 and outer reflector rim 46 in order to permit such tilting of the reflector 18.

The reference numeral 80 in FIGS. 1-3 generally denotes a rear cover of elastomeric material watertightly closing the gap between lamp body rim 26 and reflector rim 46 without interfering with aiming operation. Generally annular in shape, the rear cover 80 has an inner rim 82 closely fitted over the outer reflector rim 46. Also, the rear cover 80 has an outer rim 84 closely fitted over the rim 26 on the rear end of the lamp body 12. Furthermore, as will be noted from FIGS. 1 and 2, the outer rim 84 has a groove 86 formed in its inner surface for closely receiving a flange 88 on the rear end of the lamp body rim 26. Thus the rear cover 80 is prevented from accidental detachment from the lamp body 12.

Antiglare Shade Structure

Figure 5A:
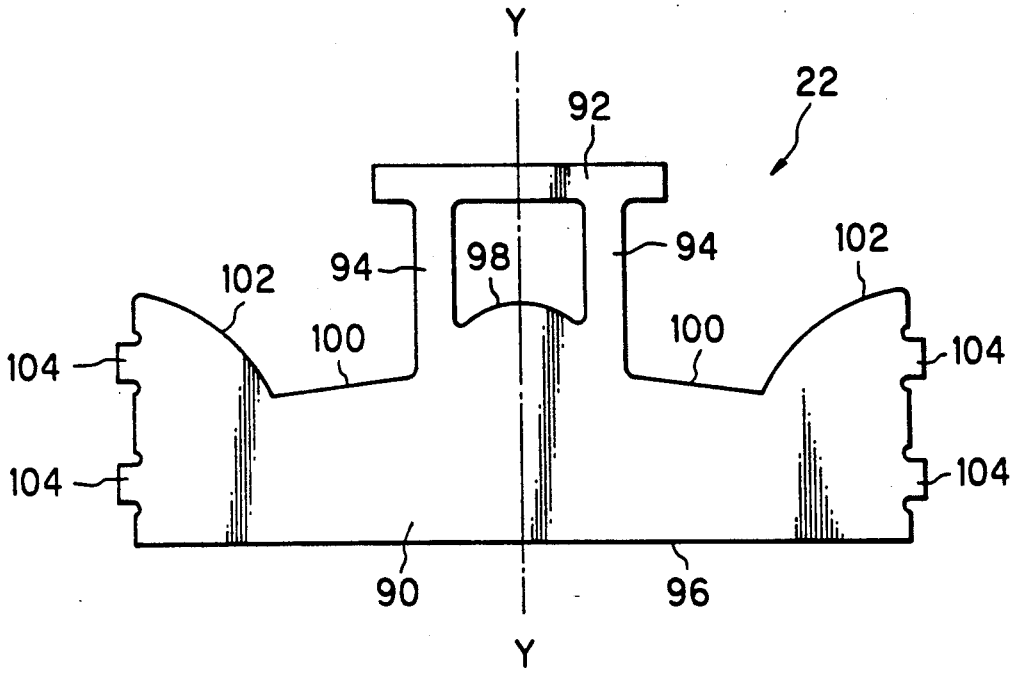
FIG. 5A is a developed view of the antiglare shade structure.
Figure 5B:
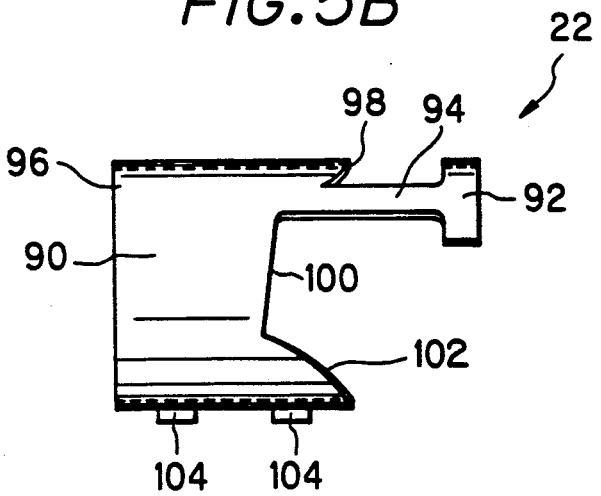
FIG. 5B is a side elevation of the antiglare shade structure.

We have shown the antiglare shade structure 22 in perspective in FIG. 4, in developed view in FIG. 5A, and in side elevation in FIG. 5B, although it appears also in FIGS. 1 and 2.

The antiglare shade structure 22 takes the form of a punching of sheet metal, preferably of aluminum steel, in this particular embodiment. Functionally, it may be considered to comprise a front portion 90, a rear portion 92, and a pair of connective portions 94 joining the front and the rear portion. The front shade portion 90 is substantially tubular in shape whereas the rear shade portion 92 is in the shape of a strip curved with approximately the same radius as the front shade portion. The pair of connective portions 94 extend between the two shade portions 90 and 92 in parallel spaced relation to each other.

When developed as shown in FIG. 5A, the antiglare shade structure 22 is of bilateral symmetry with respect to an axis Y—Y. The front shade portion 90 has a straight front edge 96, a convex rear edge portion 98, a pair of straight rear edge portions 100 which are angled forwardly as they extend away from the axis Y—Y, and a pair of curved rear edge portions 102 which are angled rearwardly as they extend from the axis Y—Y. Further the front shade portion 90 is formed to include two pairs of lugs 104 at its opposite ends.

The pairs of lugs 104 are all to be bent in the same direction before rounding the sheet metal shade structure 22. When it is subsequently rounded, the two pairs of bent lugs 104 will come into abutment against each other. The butting lugs 104 may then be welded together in order to maintain the antiglare shade structure 22 in the shape illustrated in FIGS. 4 and 5B.

Shade Support Structure

FIG. 4 best illustrates the shade support structure 24 for supporting the antiglare shade structure 22 in position with respect to the reflector 18 and bulb 20. The shade support structure 24 also takes the form of a punching of sheet metal, subsequently bent into the shape illustrated. Thus the support structure 24 comprises a flat rest 106 disposed horizontally under the front portion 90 of the antiglare shade structure 22, and a pair of legs 108 depending from the opposite sides of the front end portion of the rest 106. Each leg 108 has a toe or lateral extension 110 having a hole 112 formed therein.

As will be noted by referring back to FIG. 1, the antiglare shade structure 22 has its front portion 90 seated against the rest 106 of the support structure 24. Further the noted pairs of butt welded lugs 104 of the shade structure 22 are engaged in openings 114 formed in the rest 106. The shade structure 22 and support structure 24 are welded together in this state.

It will be also observed from FIG. 1 that the reflector 18 is stepped at 116. A pair of mounts 118 each having a tapped hole 120 are formed on the step 116. The support structure 24 is secured to the mounts 118, and hence to the reflector 18, by screws 122 passing through the clearance holes 112 in the toes 110 of the support structure and engaged in the tapped holes 120 in the mounts.

Operation

Figure 6:
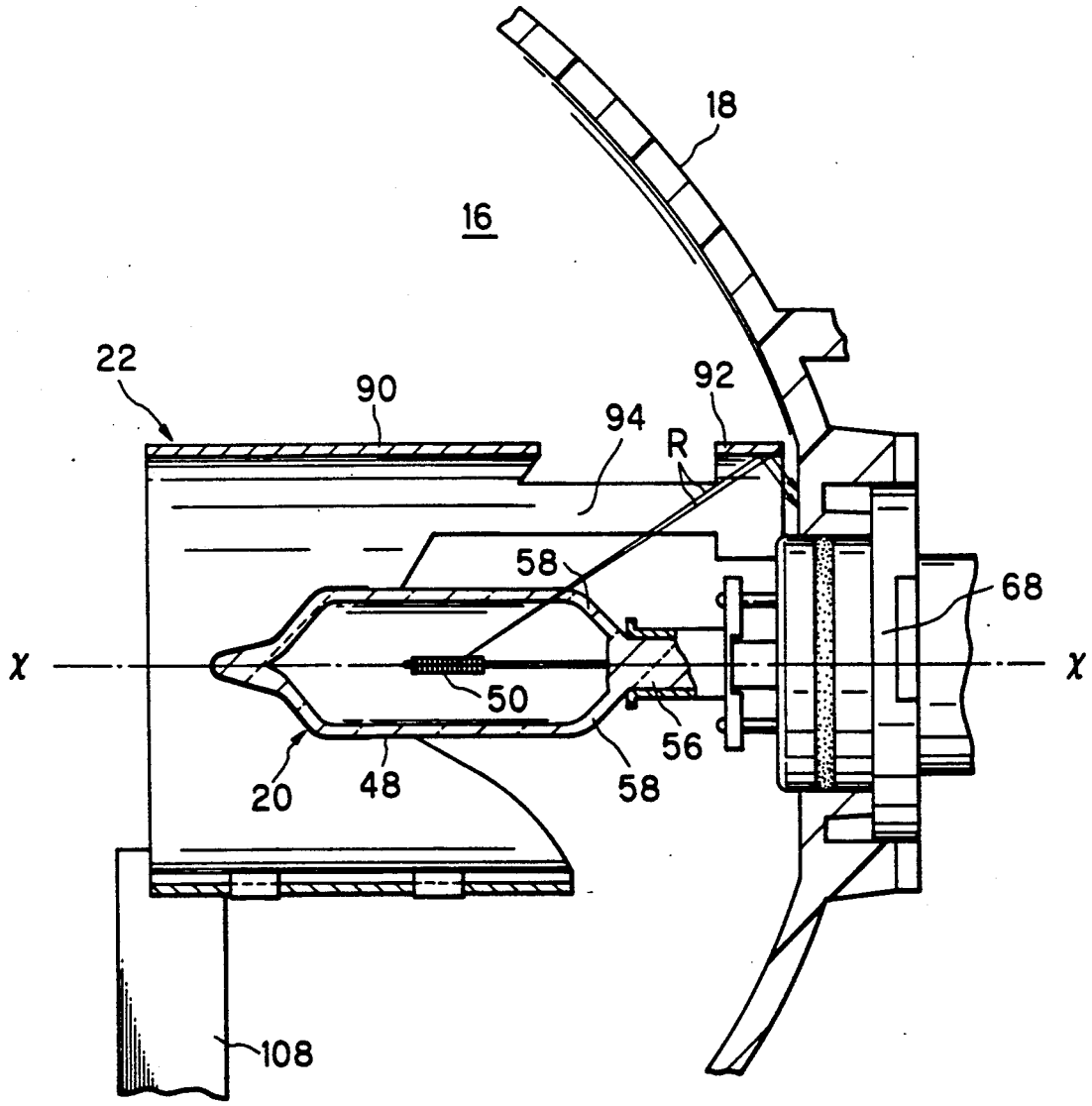
FIG. 6 is an enlarged, fragmentary vertical section through the headlamp, which is explanatory of how undesired light rays emitted by the bulb are cut off for the prevention of glare according to our invention.

The functions of the antiglare shade structure 22 will become apparent from an inspection of FIG. 6. With the shade structure mounted as above in the lighting chamber 16, the front shade portion 90 loosely encircles approximately the front half of the lighting bulb 20. The rear shade portion 92, on the other hand, is disposed above and behind the bulb 20 and close to the central part of the reflector 18.

The front shade portion 90 serves to cut off the rays of light that, emitted by the bulb filament 50, have passed through the tubular envelope portion 48 of the bulb but which, were it not for the front shade portion 90, would hit the forward extension 38, FIGS. 1 and 2, of the reflector 18. We know that such a bulb shade is conventional in the art, so that the front shade portion 90 does not per se constitute a feature of our invention.

Our invention particularly features the rear shade portion 92 and its structural and functional relations to the other parts of the headlamp 10. As indicated in FIG. 6, the rear shade portion 92 functions to shield the reflector 18 from some of the light rays that have been emitted by the bulb filament 50 and that have passed through the indefinitely tapering part 58 of the bulb 20. It will be noted that the rear shade portion 92 serves to cut off only the light rays R issuing upwardly from the upper portion of the indefinitely tapering part. That is because it is only these light rays R that, if allowed to impinge directly on the reflector 18, would cause glare. Thus, with the unnecessary light rays effectively cut off by the antiglare shade structure 22, this headlamp 10 will produce a sharply delineated beam pattern with a minimum of glare causing rays.

ALTERNATE EMBODIMENT

Figure 7:
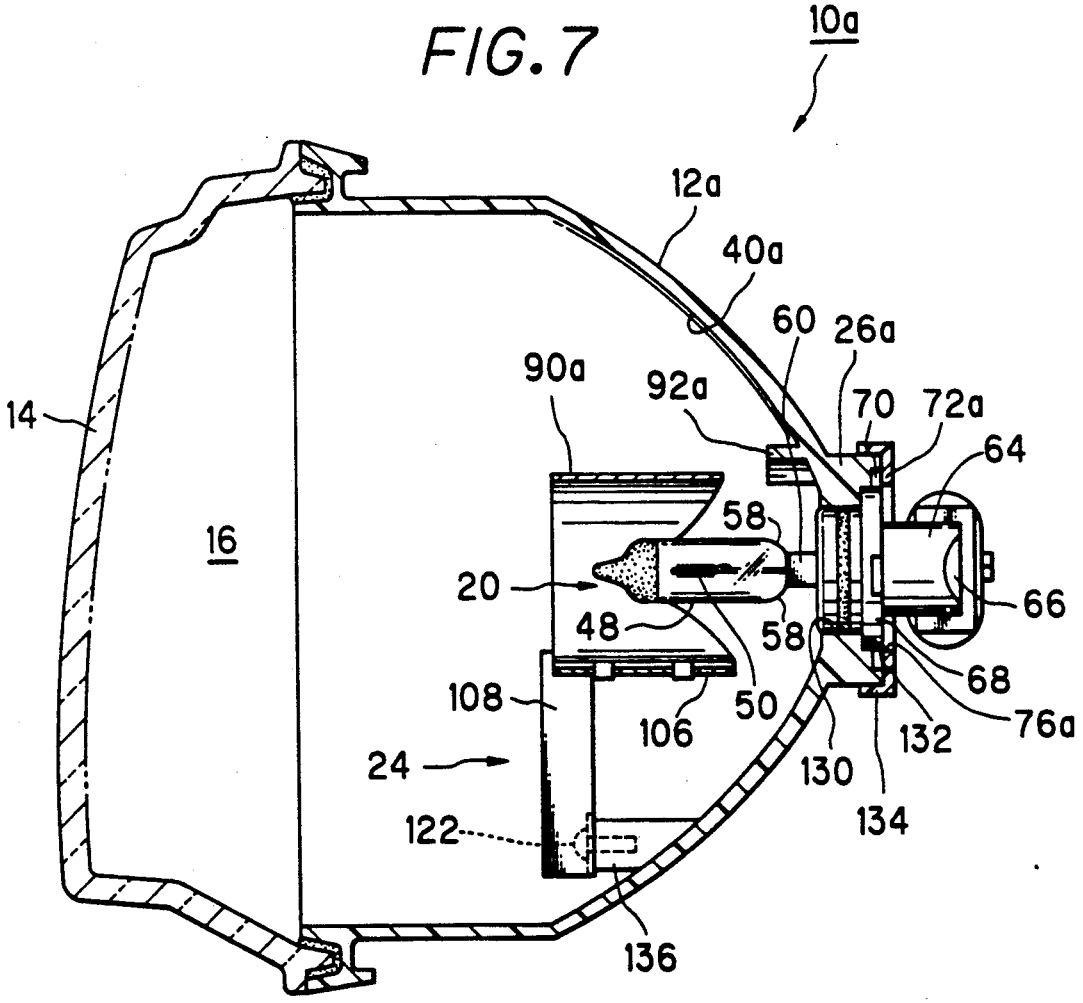
FIG. 7 is a vertical section through a nonaimable vehicle headlamp embodying the principles of our invention.
Figure 8:
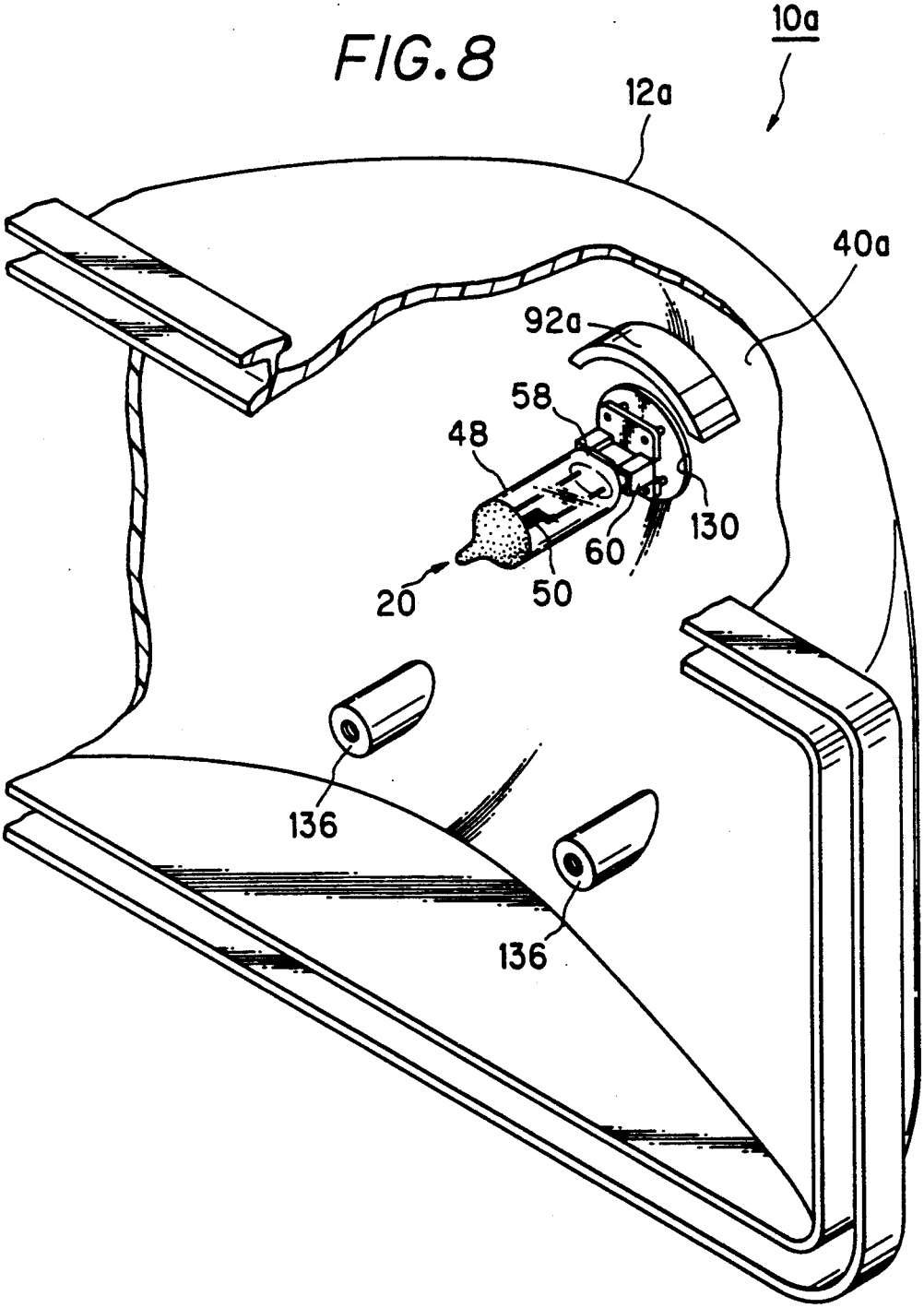
FIG. 8 is an enlarged, fragmentary perspective view showing only the lamp body and the bulb mounted thereto of the FIG. 7 headlamp.

We have illustrated in FIGS. 7 and 8 our invention as alternatively embodied in a nonaimable vehicle headlamp 10a. The alternate headlamp 10a comprises a lamp body 12a having the cover lens 14 secured to its open front end to define the lighting chamber 16. It will be observed from FIG. 7 that the cover lens 14 is secured to the lamp body 12a in the same way as the cover lens is secured to the lamp body 12 in the FIGS. 1–6 headlamp 10.

Molded from a plastic, the lamp body 12a has a reflective layer 40a formed on its paraboloidal inside surface as by vapor deposition of aluminum. Thus, despite the naming, the lamp body 12a of this alternate headlamp 10a serves the purposes of both lamp body 12 and reflector 18 of the first disclosed headlamp 10. We could therefore call the lamp body 12a a reflector.

The lamp body 12a has an annular rim 26a extending rearwardly from its rear end and defining a hole 130. The lighting bulb 20 is to be inserted forwardly in and through the hole 130 into the lighting chamber 16. The lamp body rim 26a is internally recessed annularly at 132 for receiving the flange 68, complete with the radial lugs 70, on the bulb socket 64.

At 72a is seen a bulb retainer ring which is similar to the bulb retainer ring 72, FIGS. 1–3, of the first disclosed headlamp 10 and which defines a hole 76a somewhat more in diameter than the socket flange 68. It is also understood that the bulb retainer ring 72a has internal recesses, not shown, similar to the recesses 78, FIG. 3, in the ring 72 of the headlamp 10. Unlike the ring 72, however, the bulb retainer ring 72a of this alternate headlamp 10a is formed in one piece with an annular rim 134 to fit closely over the lamp body rim 26a.

Thus, for mounting the bulb 20 in the lighting chamber 16, the bulb may be inserted in and through the hole 130 until, with the lugs 70 on the socket flange 68 directed through the unshown recesses in the bulb retainer ring 72a, the socket flange becomes seated in the recess 132 in the lamp body rim 26a. Then the bulb socket 64 may be turned in either direction for engaging the lugs 70 between lamp body rim 26a and bulb retainer ring 72a.

This alternate headlamp 10a employs a front antiglare shade 90a and a rear antiglare shade 92a in place of the combined antiglare shade structure 22 of the preceding embodiment. Shaped exactly like the front portion 90 of the shade structure 22, the front shade 90a is disposed around the bulb 20 and mounted to the lamp body 12a via the support structure 24. This support structure is also identical in construction with that of the preceding embodiment. However, in this alternate headlamp 10a, the support structure 24 is screwed at 122 to a pair of bosses 136 formed on the inside surface of the lamp body 12a so as to extend forwardly therefrom.

A most pronounced feature of this headlamp 10a resides in the rear antiglare shade 92a formed on the inside surface of the lamp body 12a in one piece therewith and in a position above the bulb 20. Like the rear portion 92 of the shade structure 22, the rear antiglare shade 92a is in the shape of a strip, curved about the optical axis of the headlamp 10a.

It will therefore be apparent that, like the rear portion 92 of the antiglare shade structure 22 of the FIGS. 1–6 headlamp 10, the rear antiglare shade 92a functions to effectively cut off those of the light rays that have passed through the indefinitely tapering part 58 of the bulb envelope portion 48 which, if allowed to impinge directly on the reflective surface 40a of the lamp body 12a, would cause glare. It should be appreciated that, being molded in one piece with the lamp body 12a, the rear antiglare shade 92a does not in any way make difficult the assemblage of the headlamp 10a.

Although we have shown and described our invention in terms of but two preferred embodiments thereof, we recognize, of course, that our invention can be embodied in other forms within the broad teaching hereof. For example, instead of cutting off only some of the random light rays that have traversed the indefinitely tapering part of the bulb, either by the rear portion 92 of the antiglare shade structure 22 or by the rear antiglare shade 92a, we could shield practically all such random rays from the reflector by modifying the shape of the antiglare shade structure or the rear antiglare shade. Also, in both headlamps 10 and 10a disclosed, we could employ a bulb in which the filament extends at right angles to the optical axis, instead of the illustrated bulb having the filament in alignment with the optical axis.

It is also to be understood that some features of the two disclosed headlamps 10 and 10a are interchangeable. Thus, for example, we could incorporate the combined antiglare shade structure 22 with the non-aimable headlamp 10a, and the separate antiglare shades of 90a and 92a with the aimable headlamp 10.

All these and other modifications, alterations and adaptations of our invention are intended in the foregoing disclosure. It is therefore appropriate that our invention be construed broadly and in a manner consistent with the fair meaning or proper scope of the claims which follow.

We claim:

1. A vehicle headlamp comprising:

(a) a lamp body;

(b) a lens secured to the lamp body to define a lighting chamber therebetween, the lighting chamber having an optical axis extending through the lens;

(c) an electric lighting bulb mounted to the lamp body and disposed in the lighting chamber along the optical axis, the bulb having an envelope portion of vitreous material containing a filament for emitting rays of light, and a base portion formed in one piece with the envelope portion by pinch sealing, with the consequent creation of an indefinitely tapering part between the envelope portion and the base portion;

(d) a reflector in the lighting chamber for reflecting the light rays that have been emitted by the filament of the bulb and which have passed through the envelope portion, and hence for producing light rays that are parallel to the optical axis; and (e) an antiglare shade comprising at least a rear portion disposed between a rear portion of the bulb and the reflector for cutting off primarily light rays that have been emitted by the filament of the bulb and which have issued upwardly through an upper portion of the indefinitely tapering part of the bulb, in order to prevent the reflector from producing light rays that are angled with respect to the optical axis, said antiglare shade being in the form of an arcuate strip of rigid material disposed only above and to the rear of said bulb.

2. The antiglare vehicle headlamp of claim 1 wherein the antiglare shield further comprises a front portion disposed between the bulb and the reflector for cutting off light rays that have been emitted by the filament of the bulb and which have passed through part of the envelope portion of the bulb, in order to further prevent the reflector from producing light rays that are angled with respect to the optical axis.

3. A vehicle headlamp comprising:

(a) a lamp body;

(b) a lens secured to the lamp body to define a lighting chamber therebetween, the lighting chamber having an optical axis extending through the lens;

(c) an electric lighting bulb mounted to the lamp body and disposed in the lighting chamber along the optical axis, the bulb having an envelope portion of vitreous material containing a filament for emitting rays of light, and a base portion formed in one piece with the envelope portion by pinch sealing, with the consequent creation of an indefinitely tapering part between the envelope portion and the base portion;

(d) a reflector in the lighting chamber for reflecting the light rays that have been emitted by the filament of the bulb and which have passed through a first part of the envelope portion of the bulb, and hence for producing light rays that are parallel to the optical axis; and (e) an antiglare shade comprising:

(1) a front portion of tubular shape loosely surrounding the bulb for cutting off light rays that have been emitted by the filament of the bulb and which have passed through a second part of the envelope portion of the bulb, in order to prevent the reflector means for producing light rays that are angled with respect to the optical axis; and a (2) rear portion disposed between a rear portion of the bulb and the reflector for cutting off primarily light rays that have been emitted by the filament of the bulb and which have issued upwardly through an upper portion of the indefinitely tapering part of the bulb, in order to prevent the reflector from producing light rays that are angled with respect to the optical axis, the rear portion of the antiglare shield being in the form of an arcuate strip of rigid material disposed only above and to the rear of the bulb.

4. The vehicle headlamp of claim 3 wherein the front and rear portions of the antiglare shade are of one piece construction of sheet material.

5. The vehicle headlamp of claim 4 wherein the rear portion of the glare shade is curved with approximately the same radius as the tubular front portion of antiglare shade and is joined concentrically to the front portion of the antiglare shade via a pair of connective portions.

6. A vehicle headlamp comprising:

(a) a lamp body;

(b) a lens secured to the lamp body to define a lighting chamber therebetween, the lighting chamber having an optical axis extending through the lens;

(c) an electric lighting bulb mounted to the lamp body and disposed in the lighting chamber along the optical axis, the bulb having an envelope portion of vitreous material containing a filament for emitting rays of light, and a base portion formed in one piece with the envelope portion by pinch sealing, with the consequent creation of an indefinitely tapering part between the envelope portion and the base portion;

(d) a reflector of generally concave shape mounted to the lamp body and disposed in the lighting chamber for reflecting the light rays that have been emitted by the filament of the bulb and which have passed through a first part of the envelope portion of the bulb, and hence for producing light rays that are parallel to the optical axis; and (e) an antiglare shade comprising:

(1) a front portion of tubular shape loosely surrounding the bulb for cutting off light rays that have been emitted by the filament of the bulb and which have passed through a second part of the envelope portion of the bulb, in order to prevent the reflector from producing light rays that are angled with respect to the optical axis; and (2) a rear portion disposed between a rear portion of the bulb and the reflector for cutting off primarily light rays that have been emitted by the filament of the bulb and which have issued upwardly through an upper portion of the indefinitely tapering part of the bulb, in order to prevent the reflector from producing light rays that are angled with respect to the optical axis, the rear portion of the antiglare shield being in the form of an arcuate strip of rigid material disposed only above and to the rear of the bulb.

7. The vehicle headlamp of claim 6 wherein the first and rear portions of the antiglare shade are of one piece construction of sheet material.

8. The vehicle headlamp of claim 7 wherein the rear portion of the glare shade is curved with approximately the same radius as the tubular front portion of the antiglare shade and is joined concentrically to the front portion of the antiglare shade via a pair of connective portions.

9. The vehicle headlamp of claim 7 further comprising support means for rigidly mounting the antiglare shade to the reflector.

10. The vehicle headlamp of claim 9 wherein the support means is of sheet material integrally comprising:

(a) a rest against which the front portion of the antiglare shade is seated; and (b) a pair of legs joining the rest to the reflector.

11. A vehicle headlamp comprising:

(a) a generally concave reflector;

(b) a lens secured to the reflector to define a lighting chamber therebetween, the lighting chamber having an optical axis extending through the lens;

(c) an electric lighting bulb mounted to the reflector and disposed in the lighting chamber along the optical axis, the bulb having an envelope portion of vitreous material containing a filament for emitting rays of light, and a base portion formed in one piece with the envelope portion by pinch sealing, with the consequent creation of an indefinitely tapering part between the envelope portion and the base portion;

(d) the reflector reflecting the light rays that have been emitted by the filament of the bulb and which have passed through a first part of the envelope portion of the bulb, in order to produce light rays that are parallel to the optical axis; and (e) an antiglare shade comprising:

(1) a front portion of tubular shape loosely surrounding the bulb for cutting off light rays that have been emitted by the filament of the bulb and which have passed through a second part of the envelope portion of the bulb, in order to prevent the reflector from producing light rays that are angled with respect to the optical axis; and (2) a rear portion disposed between a rear portion of the bulb and the reflector for cutting off only light rays that have been emitted by the filament of the bulb and which have issued upwardly through an upper portion of the indefinitely tapering part of the bulb, in order to prevent the reflector from producing light rays that are angled with respect to the optical axis, the rear portion of the antiglare shield being in the form of an arcuate strip of rigid material disposed only above and to the rear of the bulb.

12. The vehicle headlamp of claim 11 wherein the rear portion of the antiglare shade is formed in one piece with the reflector.

13. The vehicle headlamp of claim 11 further comprising support means for rigidly mounting the antiglare shade to the reflector.

14. The vehicle headlamp of claim 13 wherein the support means is of sheet material integrally comprising:

(a) a rest against which the front portion of the antiglare shade is seated; and (b) a pair of legs joining the rest to the reflector.

15. A vehicle headlamp comprising:

(a) a lamp body;

(b) a lens secured to the lamp body to define a lighting chamber therebetween, the lighting chamber having an optical axis extending through the lens;

(c) an electric lighting bulb mounted to the lamp body and disposed in the lighting chamber along the optical axis, the bulb having an envelope portion of vitreous material containing a filament for emitting rays of light, and a base portion formed in one piece with the envelope portion by pinch sealing, with the consequent creation of an indefinitely tapering part between the envelope portion and the base portion;

(d) a reflector of generally concave shape mounted to the lamp body and disposed in the lighting chamber for reflecting the light rays that have been emitted by the filament of the bulb and which have passed through a first part of the envelope portion of the bulb, and hence for producing light rays that are parallel to the optical axis;

(e) an antiglare shade comprising:

(1) a front portion of tubular shape loosely surrounding the bulb for cutting off light rays that have been emitted by the filament of the bulb and which have passed through a second part of the envelope portion of the bulb, in order to prevent the reflector from producing light rays that are angled with respect to the optical axis; and (2) a rear portion disposed between a rear portion of the bulb and the reflector for cutting off only light rays that have been emitted by the filament of the bulb and which have issued upwardly through an upper portion of the indefinitely tapering part of the bulb, in order to prevent the reflector from producing light rays that are angled with respect to the optical axis, the rear portion of the antiglare shield being in the form of an arcuate strip of rigid material disposed above and to the rear of the bulb, said front and rear portions of the antiglare shield being of one piece construction of sheet metal, the rear portion of the antiglare shield being curved with approximately the same radius as the tubular front portion of the antiglare shield and then joined concentrically to the front portion of the antiglare shield via a pair of connective portions; and (f) support means for rigidly mounting the antiglare shield to the reflector, said support means being made of sheet material integrally comprising:

(1) rest against which the front portion of the antiglare shield is seated; and (2) a pair of legs joining the rest to the reflector.

16. A vehicle headlamp comprising:

(a) a generally concave reflector;

(b) a lens secured to the reflector to define a lighting chamber therebetween, the lighting chamber having an optical axis extending through the lens;

(c) an electric lighting bulb mounted to the reflector and disposed in the lighting chamber along the optical axis, the bulb having an envelope portion of vitreous material containing a filament for emitting rays of light, and a base portion formed in one piece with the envelope portion by pinch sealing, with the consequent creation of an indefinitely tapering part between the envelope portion and the base portion;

(d) the reflector reflecting the light rays that have been emitted by the filament of the bulb and which have passed through a first part of the envelope portion of the bulb, in order to produce light rays that are parallel to the optical axis; and (e) an antiglare shade comprising:

(1) a front portion of tubular shape loosely surrounding the bulb for cutting off light rays that have been emitted by the filament of the bulb and which have passed through a second part of the envelope portion of the bulb, in order to prevent the reflector from producing light rays that are angled with respect to the optical axis; and (2) a rear portion disposed between a rear portion of the bulb and the reflector for cutting off only light rays that have been emitted by the filament of the bulb and which have issued upwardly through an upper portion of the indefinitely tapering part of the bulb, in order to prevent the reflector from producing light rays that are angled with respect to the optical axis, the rear portion of the antiglare shield being in the form of an arcuate strip of rigid material disposed above and to the rear of the bulb.

* * * * *